United States Patent [19]

Hirozawa et al.

[11] 3,971,706

[45] July 27, 1976

[54] METHOD OF REJUVENATING ALKALI-CELL DIAPHRAGMS

[75] Inventors: Stanley T. Hirozawa, Birmingham; William K. Langdon, Grosse Ile, both of Mich.

[73] Assignee: BASF Wyandotte Corporation, Wyandotte, Mich.

[22] Filed: Oct. 1, 1975

[21] Appl. No.: 618,451

[52] U.S. Cl. ..... 204/98; 204/128

[51] Int. Cl.[2] ..... C25B 1/16; C25B 1/26

[58] Field of Search ..... 204/98, 128, 295, 296

[56] References Cited

UNITED STATES PATENTS 3,772,269 11/1973 Lew ..... 260/210 R

FOREIGN PATENTS OR APPLICATIONS 594,888 3/1960 Canada ..... 204/98

*Primary Examiner*—R. L. Andrews

*Attorney, Agent, or Firm*—John W. Linkhauer; Bernhard R. Swick; Robert E. Dunn

[57] ABSTRACT

By adding to the anolyte of an alkali-brine electrolysis cell of the kind that has a diaphragm of relatively hydrophobic material such as polytetrafluoroethylene, a small quantity of $C_8$ to $C_{14}$ alkyl glycoside, the wetting performance of said anolyte is much improved, and in some instances, good flow of anolyte through the diaphragm is readily re-established, without need for dismantling the cell to re-wet the diaphragm.

6 Claims, No Drawings

METHOD OF REJUVENATING ALKALI-CELL DIAPHRAGMS

BACKGROUND OF THE INVENTION

1. Field of the Invention

This invention relates to the art of operating cells that are used for the electrolysis of brine to produce chlorine and caustic, and in particular to such cells wherein a diaphragm divides the cell into anolyte and catholyte portions, with the diaphragm being of relatively hydrophobic material such as highly crystalline polytetrafluoroethylene. It concerns a method of re-wetting the diaphragm so that flow therethrough may be re-established at a desired greater value.

2. Description of the Prior Art

The operation of diaphragm-type electrolytic cells to produce caustic and chlorine is well known to those skilled in the art. Though it has been usual to use asbestos for the diaphragms of such cells, there has recently been a trend to change to different diaphragm materials, such as crystalline polytetrafluoroethylene, because of the considerable occupational-hazard problems encountered in the manufacture of asbestos and the expense of meeting them. The crystalline polytetrafluoroethylene material is quite satisfactory as a diaphragm material, except for its drawback of being rather hydrophobic and consequently tending to dewet while in service. When the diaphragm dewets, flow of material through the diaphragm slows down greatly or even substantially stops. It has often been necessary to halt the electrolysis operation when this happens and possibly also disassemble the cell in order to take appropriate steps to bring the diaphragm back into service.

In the operation of a diaphragm cell, the efficiency of the entire operation is importantly affected by the flow of liquid through the diaphragm. The brine can be supplied to the anolyte chamber only at a rate such that, considering the flow through the diaphragm, the level in the anolyte chamber remains at a tolerable level. It is usual for a diaphragm to begin to be somewhat slow in passing liquid after some days or weeks of service. Diaphragms of polytetrafluoroethylene sometimes pass liquid too slowly even at the start-up of an electrolysis operation because they have become partially dewetted before the electrolysis begins.

Many wetting agents are known, but most of them are not at all satisfactory for use in connection with a cell for the electrolysis of brine to produce caustic and chlorine. The usual nonionic wetting agents (ones of the propylene oxide-ethylene oxide type) are substantially unstable or insoluble in alkaline media.

DESCRIPTION OF THE PREFERRED EMBODIMENTS

The invention comprises the improvement, in a process of electrolyzing an aqueous solution of alkali-metal halide in a cell having a porous and hydrophobic diaphragm between the anolyte and catholyte compartments of said cell, which consists in adding to brine fed to said cell an amount of $C_8$ to $C_{14}$ alkyl glycoside, preferably decyl glycoside, effective to cause wetting of said diaphragm. Most usually the alkali-metal halide is sodium chloride. Concentrations of $C_8$ to $C_{14}$ alkyl glycoside on the order of 50 to 2000 parts per million in the brine are effective. The invention is of particular usefulness in connection with the use of diaphragms of highly crystalline polytetrafluoroethylene, such as a material commercially available for use as electrolysis-cell diaphragms which is sold by W. L. Gore and Associates, Inc., Elkton, Maryland, under the trademark "GORE-TEX".

Suitable alkyl glycoside compositions may be prepared in various ways well known to those skilled in the chemistry of carbohydrate derivatives. Adequate directions for the preparation of a suitable decyl glycoside appear in U.S. Pat. No. 3,772,269. We have obtained suitable results by reacting cornstarch, first, with propylene glycol and then with n-decanol under conditions that yield a product which consists mainly of decyl glucoside, i.e., a product having an average of about one anhydroglucose unit (AGU) per molecule.

Experiments with a laboratory-scale electrolysis cell having a diaphragm with an area of 116 square centimeters have been performed. Under usual conditions, when such equipment is operating satisfactorily, the rate of flow of electrolyte through the diaphragm is on the order of 6 to 12 milliliters per minute. If the diaphragm becomes dewetted or plugged, the rate of flow decreases to 2 milliliters per minute or less. We have found that additions of decyl glycoside to the brine may be used to restore the desired greater flow rates, permitting the in situ re-wetting of the diaphragm and saving the labor and expense which attend a re-wetting of the diaphragm by methods previously known, which necessarily involve disassembling and re-assembling the electrolysis cell.

The invention is illustrated by the following specific Examples.

EXAMPLE I

A highly crystalline polytetrafluoroethylene diaphragm having an area of 116 square centimeters was wetted with an acetone solution containing one percent by weight of a polyglycol nonionic surfactant, and then put into service in a diaphragm-type chlor-alkali electrolysis cell. An initial flow rate through the diaphragm of 2.3 milliliters per minute was observed. Inasmuch as such flow rate was substantially less than the flow rate ordinarily obtained with diaphragms of similar dimensions freshly installed in the same equipment, it was deduced that the diaphragm inadvertently become dewetted. Addition of 1000 parts per million of decyl glycoside to the brine had the effect, within one hour, of raising the flow rate through the diaphragm to 6.5 milliliters per minute, which value was thereafter maintained.

EXAMPLE II

A chlor-alkali cell for the electrolysis of brine was operated with a diaphragm of highly crystalline polytetrafluoroethylene having an area of 116 square centimeters for a period of three days under conditions usual for such cell, i.e., 50 percent salt cut, 75 millimeters head, and current efficiency of 87 percent. The diaphragm of the cell became dewetted, as was apparent from (1) the increase in the voltage required in order to maintain the desired current density from an initial 4.6 volts to 10 volts and (2) the decrease in the flow of brine through the diaphragm from a normal value of about 6.5 milliliters per minute or more to a low value, i.e., 1.6 milliliters per minute, even though the head had been increased to 450 millimeters. Decyl glycoside was added to the anolyte-5 milliliters of a solution of 10 weight percent of decyl glycoside dissolved in saturated brine. This made the concentration of decyl glycoside in the brine of the anolyte approximately 1250 parts per million. A remarkable improvement in the operation of the cell was obtained; within 45 minutes, the flow rate through the diaphragm rose to about 7 milliliters per minute and then remained at such higher value for approximately 1 hour and 15 minutes. Thereafter, however, over the course of the next hour, the flow rate decreased to less than 3 milliliters per minute. A second addition of decyl glycoside (also 5 milliliters) was then made. Within 15 minutes the flow rate through the diaphragm rose to over 8 milliliters per minute and remained at such value or higher for at least 2.5 hours.

EXAMPLE III

A laboratory-scale diaphragm-type chlor-alkali electrolysis cell was being operated with a diaphragm of highly crystalline polytetrafluoroethylene. The cell was permitted to operate over a weekend, and on Monday morning, it was discovered that the flow rate through the diaphragm had decreased to nil. There was then made an addition to the anolyte of 0.4 milliliter of the same solution as that used in Example II, i.e., a solution prepared by diluting 20 milliliters of an aqueous solution containing 50 weight percent of decyl glycoside with saturated brine to obtain a total volume of 100 milliliters, thereby obtaining a solution of 10 weight percent of decyl glycoside. Addition of 0.4 milliliter of such solution to the anolyte made the concentration of decyl glycoside in the anolyte 100 parts per million.

Almost immediately there was a resumption of substantial flow of electrolyte through the diaphragm. Within half a minute, the flow rate increased to 8 milliliters per minute, and it later increased to between 10 and 11 milliliters per minute and remained at such value for a substantial period of time.

While we have shown and described herein certain embodiments of our invention, we intend to cover as well any change or modification therein which may be made without departing from its spirit and scope.

We claim:

1. In a process of electrolyzing an aqueous solution of alkali-metal halide in a cell having a porous and hydrophobic diaphragm between the anolyte and catholyte compartments of said cell, the improvement which consists in adding to brine fed to said cell an amount of $C_8$ to $C_{14}$ glycoside effective to cause wetting of said diaphragm.

2. An improvement as defined in claim 1, characterized in that said glycoside is decyl glycoside.

3. An improvement as defined in claim 2, said alkali-metal halide being sodium chloride.

4. An improvement as defined in claim 3, characterized in that said glycoside is decyl glycoside.

5. An improvement as defined in claim 4, characterized in that said decyl glycoside is present in said brine in an amount of 50 to 2000 parts per million by weight.

6. An improvement as defined in claim 1, characterized in that said alkyl glycoside is present in said brine in an amount of 50 to 2000 parts per million by weight.

* * * * *